US008469093B2

(12) United States Patent
Rondeau

(10) Patent No.: US 8,469,093 B2
(45) Date of Patent: Jun. 25, 2013

(54) APPARATUS AND METHOD FOR AUTOFILL EQUIPMENT ACTIVATION

(75) Inventor: Joel Rondeau, Antony (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 361 days.

(21) Appl. No.: 12/846,927

(22) Filed: Jul. 30, 2010

(65) Prior Publication Data

US 2012/0024546 A1 Feb. 2, 2012

(30) Foreign Application Priority Data

Jul. 30, 2010 (EP) ..... 09290634

(51) Int. Cl.
*E21B 33/16* (2006.01)

(52) U.S. Cl.
USPC ..... 166/291; 166/177.4

(58) Field of Classification Search
USPC ..... 166/285, 291, 177.3, 177.4
See application file for complete search history.

(56) References Cited

U.S. PATENT DOCUMENTS

| | | | | |
|---|---|---|---|---|
| 3,730,267 | A | 5/1973 | Scott | |
| 3,759,281 | A | 9/1973 | Falcuta | |
| 3,995,692 | A | 12/1976 | Seitz | |
| 4,532,995 | A | 8/1985 | Kaufman | |
| 4,872,510 | A | 10/1989 | Lehr et al. | |
| 4,953,622 | A | 9/1990 | Lehr et al. | |
| 5,829,523 | A | 11/1998 | North | |
| 5,890,538 | A | 4/1999 | Beirute et al. | |
| 6,390,200 | B1 | 5/2002 | Allamon et al. | |
| 6,491,103 | B2 | 12/2002 | Allamon et al. | |
| 6,497,291 | B1 | 12/2002 | Szarka | |
| 6,679,336 | B2 | 1/2004 | Musselwhite et al. | |
| 6,684,957 | B2 | 2/2004 | Allamon | |
| 6,712,145 | B2 | 3/2004 | Allamon | |
| 6,715,541 | B2 | 4/2004 | Pedersen et al. | |
| 6,725,917 | B2 | 4/2004 | Metcalfe | |
| 6,742,591 | B2 | 6/2004 | Metcalfe | |
| 6,752,209 | B2 | 6/2004 | Mondelli et al. | |
| 6,776,228 | B2 | 8/2004 | Pedersen et al. | |
| 6,802,372 | B2 | 10/2004 | Budde | |
| 6,848,511 | B1 * | 2/2005 | Jones et al. | 166/386 |
| 7,143,831 | B2 | 12/2006 | Budde | |
| 7,182,135 | B2 | 2/2007 | Szarka | |
| 7,357,181 | B2 | 4/2008 | Webb et al. | |

(Continued)

FOREIGN PATENT DOCUMENTS

| | | |
|---|---|---|
| EP | 1380721 | 10/2006 |
| GB | 2457285 | 8/2009 |
| WO | 20060051321 | 5/2006 |

OTHER PUBLICATIONS

Leugemors E., Metson J., Colvard RL., Krauss CD and Plante M.: "Cementing Equipment and Casing Hardware", in Nelson EB and Guillot D (eds): Well Cementing 2nd Edition, Houston: Schlumberger (2006): 343-434.

*Primary Examiner* — William P Neuder
(74) *Attorney, Agent, or Firm* — Michael Dae

(57) ABSTRACT

A bottom cementing plug is equipped to activate autofill float equipment. The bottom cementing plug contains an activation device that is released when the plug lands on the autofill equipment, then enters the autofill equipment, triggering the activation of check valves. The activation device may also contain a chemical substance that is released into the well when the activation device exits the bottom cementing plug.

20 Claims, 6 Drawing Sheets

U.S. PATENT DOCUMENTS

| | | | | |
|---|---|---|---|---|
| 7,484,559 | B2 | 2/2009 | Vert et al. | |
| 7,503,398 | B2 | 3/2009 | LoGiudice et al. | |
| 7,527,104 | B2 | 5/2009 | Branch et al. | |
| 7,533,728 | B2 | 5/2009 | Winslow et al. | |
| 2001/0045288 | A1 | 11/2001 | Allamon | |
| 2002/0033262 | A1* | 3/2002 | Musselwhite et al. | 166/285 |
| 2003/0047314 | A1 | 3/2003 | Allamon | |
| 2003/0047315 | A1 | 3/2003 | Allamon | |
| 2003/0155114 | A1 | 8/2003 | Pedersen | |
| 2003/0155115 | A1 | 8/2003 | Pedersen | |
| 2003/0230405 | A1 | 12/2003 | Allamon | |
| 2004/0007354 | A1* | 1/2004 | Allamon et al. | 166/156 |
| 2004/0020641 | A1 | 2/2004 | Budde | |
| 2004/0231836 | A1 | 11/2004 | Budde | |
| 2005/0103492 | A1 | 5/2005 | Szarka | |
| 2007/0095533 | A1* | 5/2007 | Rogers et al. | 166/285 |
| 2008/0283244 | A1 | 11/2008 | Barbee | |
| 2008/0283251 | A1 | 11/2008 | Barbee | |

* cited by examiner

APPARATUS AND METHOD FOR AUTOFILL EQUIPMENT ACTIVATION

BACKGROUND OF THE INVENTION

The statements in this section merely provide background information related to the present disclosure and may not constitute prior art.

The present invention is related in general to equipment for servicing subterranean wells. Particularly, the invention relates to a cementing plug that is equipped to activate autofill float equipment.

During a cementing operation, the primary purpose of float equipment is to allow operators to pump cement slurries into the well that are heavier than the drilling fluid. After cement-slurry placement, check valves prevent the slurry from flowing from the annulus back inside the casing or liner string—a phenomenon often called "U-tubing." Such float equipment may be float shoes or float collars Autofill float equipment contains check valves similar to those employed in conventional float shoes and collars. However, the check valves are modified to remain in the open position to allow filling or even reverse circulating. The tubular string fills continuously as it is run downhole, saving rig time and reducing the pressure surges associated with conventional float equipment.

Autofill equipment must be activated, or converted, to begin functioning as a one-direction check or float valve. Conversion is generally performed after the tubular string is in place; however, it can also occur while running the tubular string to prevent overflow or to control the well. A thorough summary of conventional and autofill float equipment is presented in the following reference: Leugemors E, Metson J, Pessin J-L, Colvard R L, Krauss C D and Plante M: "Cementing Equipment and Casing Hardware," in Nelson E B and Guillot D (eds.): *Well Cementing*—$2^{nd}$ Edition, Houston: Schlumberger (2006): 343-434.

A typical technique for activating autofill float equipment is depicted in FIG. 1. The technique is shown in five steps, shown as A through E. Step A shows an autofill float collar 1 mounted at the bottom of a tubular string 2. As the tubular string is lowered into the subterranean wellbore, the flow direction of wellbore-service fluid (e.g., drilling fluid) through the autofill float collar and tubular string is upward 3. In Step B, the wellbore-fluid circulation direction is reversed 4 so that fluid travels down the tubular string, through the float collar and up the annulus between the tubular string and the wellbore wall. A ball 5 has been launched inside the tubular string, and is traveling down toward the autofill float collar. Step C shows that the ball has entered the autofill float collar and become seated in an orifice tube 6. In Step D, continued pumping of wellbore service fluid increases the pressure above the ball, causing shear pins 7 to rupture and release the orifice tube. Ejection of the orifice tube exposes one-way flapper valves 8 and 9, allowing activation of the float collar. The flapper valves close, thereafter allowing downward fluid flow but preventing fluid flow in the upward direction. Step E depicts the autofill float collar after activation is complete.

The prior art method described in the preceding paragraph is generally reliable when applied in near vertical wells, usually up to about 30° deviation. At higher deviations, up to and including horizontal wells, the rate at which the ball travels to the float collar may not be sufficiently high, or the ball may become stuck and never reach the float collar. Failure to activate the autofill collar would allow annular fluids to reenter the tubular string.

This problem has previously been mitigated by preinstalling the activation ball in a cage mechanism located above the autofill valve, where it remains until downward circulation begins. Circulation flow forces the ball into the autofill float collar, build up backpressure and activate the valve. The limiting factors are that there is less control of valve activation, and the ball may restrict fluid flow and the solids carried therein. Another option is to locate the ball in a mechanism further uphole; however, there is still no direct control of when the autofill-valve activation takes place.

It therefore remains desirable to provide improvements in the control and reliability of equipment for activating autofill equipment.

SUMMARY OF THE INVENTION

The present invention allows such improvements.

In an aspect, embodiments relate to a bottom cementing plug equipped to activate autofill float equipment. The plug contains an interior fluid-flow passage. An activation device is secured inside the flow passage, and is supported by a breakable fixing means that ruptures when fluid flow commences inside the interior passage. A pressure sensitive membrane is located at the top of the plug that isolates the interior passage during plug placement as the plug travels down a tubular string toward the autofill float collar. Suitable activation devices include, but are not limited to, balls, darts, canisters and bombs. The activation devices may also contain chemical substances that, upon exiting the bottom cementing plug, are released into the well.

In a further aspect, various embodiments aim at a method for activating autofill float equipment. The bottom cementing plug as described is launched into the tubular body and begins traveling down the tubular string toward the autofill float collar. As the plug moves through the tubular body, the breakable membrane at the top of the plug isolates the interior-flow passage and protects the activation device located therein from exposure to fluid flow. When the cementing plug lands on the float collar, continued pumping increases the differential pressure across the membrane, and the membrane ruptures. Wellbore-service fluid enters the interior-flow passage, and flow ruptures the fixing means supporting the activation device. The activation device then exits from the bottom of the cementing plug, enters the autofill float collar and becomes lodged in the orifice tube. Continued pumping increases pressure inside the float collar, causing shear pins to break and release the orifice tube. As the orifice tube is expelled from the float collar, flapper valves are exposed. The flapper valves close, thereafter restricting fluid flow to the direction leading to the annulus between the tubular string and the wellbore wall.

The method may further comprise the use of activation devices that contain a chemical substance. The chemical substance is released into the well after exiting the bottom cementing plug.

In yet a further aspect, embodiments aim at a method for cementing a subterranean well. Drilling fluid is circulated through the tubular body equipped with a float collar, passes through the float collar, exits the tubular string and continues to travel through the annulus between the tubular string and the wellbore wall. The bottom cementing plug described is launched into the tubular body and begins traveling down the tubular string toward the float collar. The cementing plug is then followed by a cement slurry. The cement slurry may be preceded behind the cementing plug by a spacer fluid, chemical wash or both. As the plug travels through the tubular body, the breakable membrane at the top of the plug isolates the interior-flow passage and protects the activation device located therein from exposure to fluid flow. When the cementing plug lands on the float collar, continued pumping increases the differential pressure across the membrane, and the membrane ruptures. The fluid comprising a cement slurry enters the interior-flow passage, and flow ruptures the fixing means supporting the activation device. The activation device then exits from the bottom of the cementing plug, enters the autofill float collar and becomes lodged in the orifice tube. Continued pumping increases pressure inside the float collar, causing shear pins to break and release the orifice tube. As the orifice tube is expelled from the float collar, flapper valves are exposed. The flapper valves close, thereafter restricting fluid flow to the direction leading to the annulus between the tubular string and the wellbore wall. The fluid comprising a cement slurry exits the float collar and the tubular string, and continues into the annulus between the tubular string and the wellbore wall. Once pumping stops, the activated float collar prevents the cement slurry from flowing back into the tubular string.

The method may further comprise the use of activation devices that contain a chemical substance. The chemical substance is released into the well after exiting the bottom cementing plug.

The apparatus and methods described above are particularly useful in deviated wells, generally at deviations above about 30° up to and including horizontal wells. The operator knows the location of the activation device at all times, thus improving activation of the autofill float collar at the correct moment.

The apparatus and methods described above may also allow operators to measure the exact internal volume of the tubular string. Knowing the pump efficiency and recording the wellbore-service volume pumped between the time at which the bottom plug is launched, and the time at which the bottom plug lands on the autofill float equipment, it is possible to calculate the exact internal volume of the tubular string. Landing of the bottom plug on the autofill float equipment will be indicated by a pressure surge arising from rupture of the membrane on the bottom plug and breakage of shear pins in the float equipment. Knowledge of the exact internal volume gives the operator the ability to more accurately displace subsequent plugs, ensuring their timely arrival at the correct location.

DETAILED DESCRIPTION

Figure 1A:
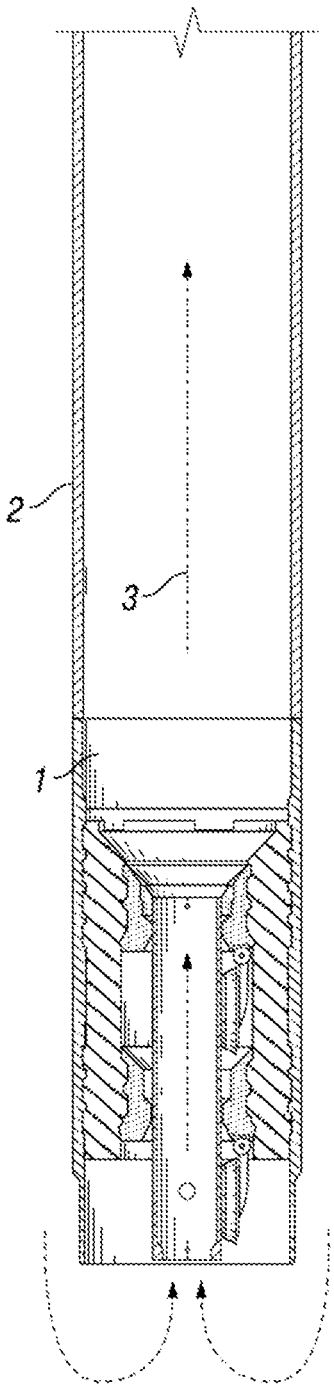
FIG. 1A (Prior Art)
FIG. 1 depicts a typical prior-art method for activating autofill float equipment, involving a free flowing activation ball.
Figure 1B:
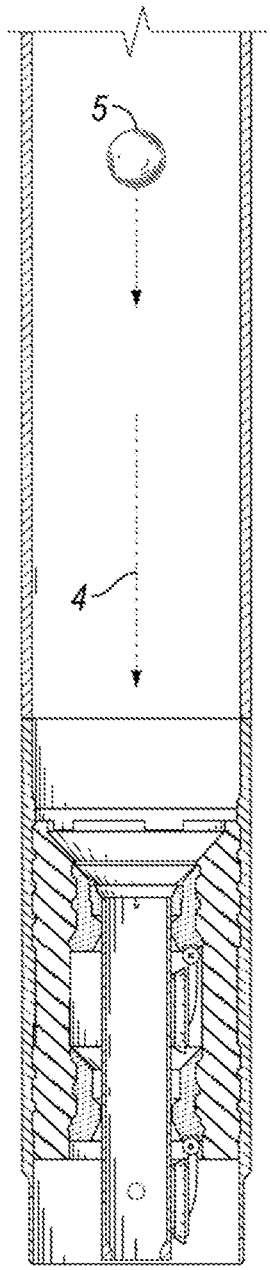
FIG. 1B (Prior Art)
Figure 1C:
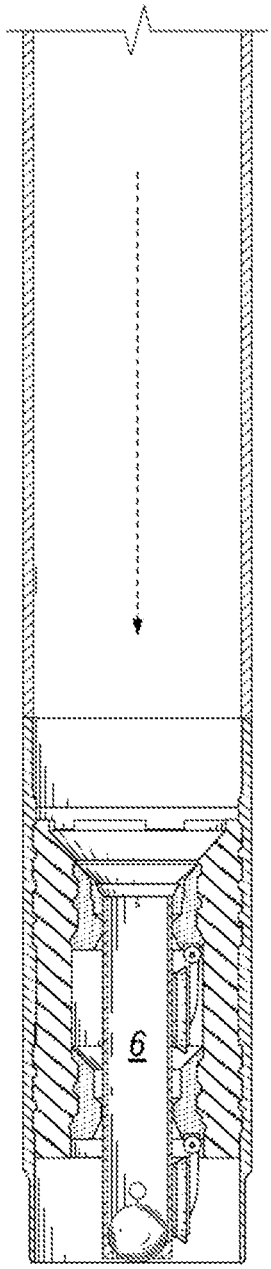
FIG. 1C (Prior Art)
Figure 1D:
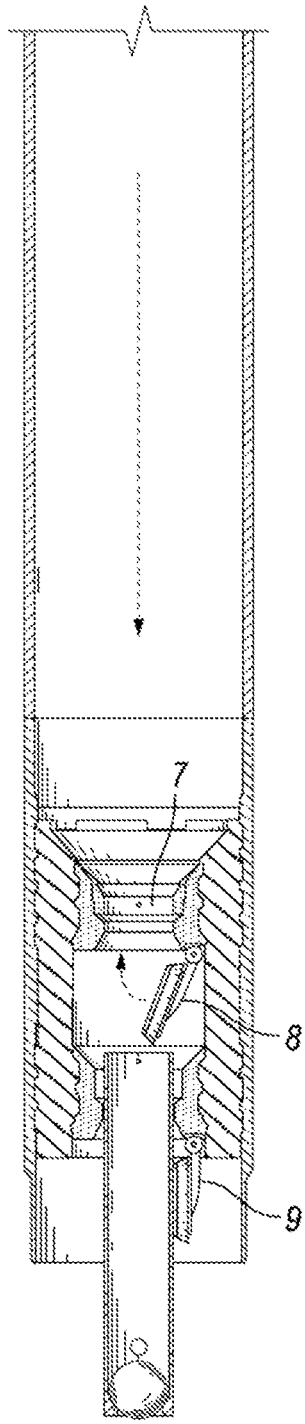
FIG. 1D (Prior Art)
Figure 1E:
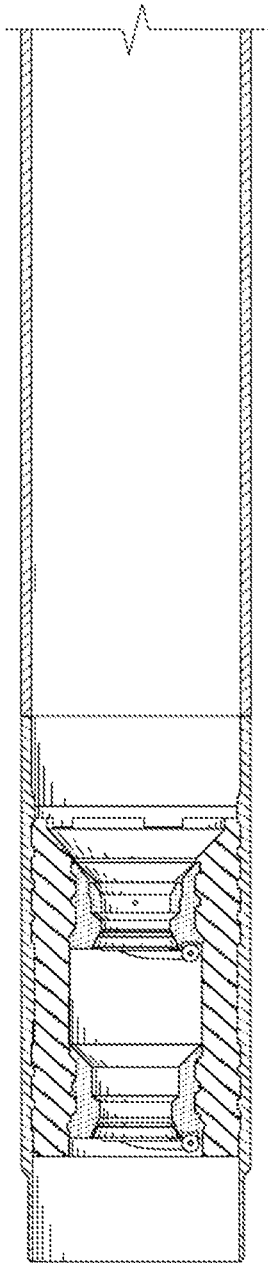
FIG. 1E (Prior Art)

When cementing the annular space between tubulars and the walls of a subterranean wellbore, it is usually necessary to minimize or prevent the commingling of the drilling fluid, spacer fluid and cement slurry. Commingling may result in adverse rheological effects, dilution of the cement slurry and compromised zonal isolation. One way to minimize commingling involves using wiper plugs to separate fluids as they travel down the tubulars. Wiper plugs also have the advantage of cleaning the inner surface of the tubulars.

After cement-slurry placement it is also desirable to prevent the cement slurry from flowing back into the tubular string. Such flowback could result in poor coverage of productive subterranean zones, compromising zonal isolation. Autofill float equipment is commonly employed to prevent such occurrences. Autofill float shoes or collars, installed at the lower end of a tubular string, allow wellbore-service fluids to flow freely inside the tubular string, in either direction, as the tubular string is lowered into the well. During the cementing process, the autofill float equipment is activated—that is, converted from a two-direction flow system to a one-direction flow system. Fluid is allowed to exit the tubular string and enter the annulus, but cannot flow backward. The activation device is usually a weighted ball that travels through the tubular string towards the autofill float equipment. The ball enters the float equipment, becomes lodged therein and causes the activation of check valves. Other activation devices that can be used in this context include, but are not limited to, darts, canisters and bombs. The activation devices may also contain chemical substances that, upon exiting the bottom cementing plug, are released into the well.

The inventor is disclosing a new apparatus for conveying the activation device to the autofill float equipment, a method by which the new apparatus is employed to effect the activation of autofill float equipment and a method by which the new apparatus is employed during a primary cementing treatment.

As mentioned herein, embodiments relate to a bottom cementing plug equipped to activate autofill float equipment. The plug contains an interior fluid-flow passage. An activation device is secured inside the flow passage, and is supported by a breakable fixing means that ruptures when fluid-flow commences inside the interior passage. A pressure sensitive membrane is located at the top of the plug that isolates the interior passage during plug placement as the plug travels down a tubular string toward the autofill float collar.

Further embodiments aim at a method for activating autofill float equipment. The bottom cementing plug described is launched normally and begins traveling down the tubular string toward the autofill float collar. As the plug travels through the tubular body, the breakable membrane at the top of the plug isolates the interior-flow passage and protects the activation device located therein from exposure to fluid flow. When the cementing plug lands on the float collar, continued pumping increases the differential pressure across the membrane, and the membrane ruptures. Wellbore-service fluid enters the interior-flow passage, and flow ruptures the fixing means supporting the activation device. The activation device then exits from the bottom of the cementing plug, enters the autofill float collar and becomes lodged in the orifice tube. Continued pumping increases pressure inside the float collar, causing shear pins to break and release the orifice tube. As the orifice tube is expelled from the float collar, flapper valves are exposed. The flapper valves close, thereafter restricting fluid flow to the direction leading to the annulus between the tubular string and the wellbore wall. A detailed description of the disclosed method is given in the following paragraph.

Figure 2A:
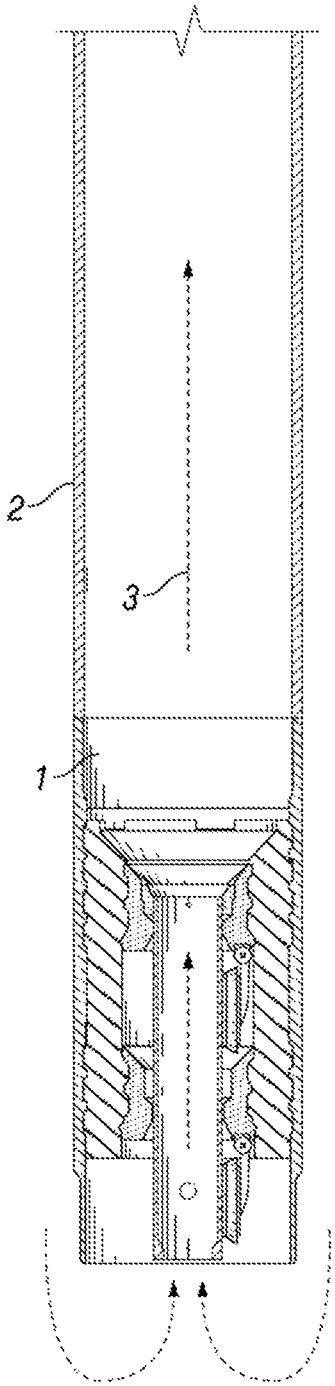
FIG. 2 depicts the inventive method for activating autofill float equipment, involving a cementing bottom plug that contains an activation ball.
Figure 2B:
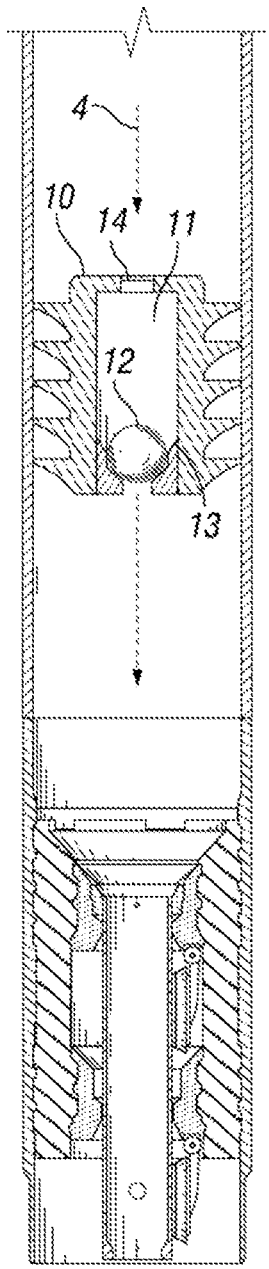
Figure 2C:
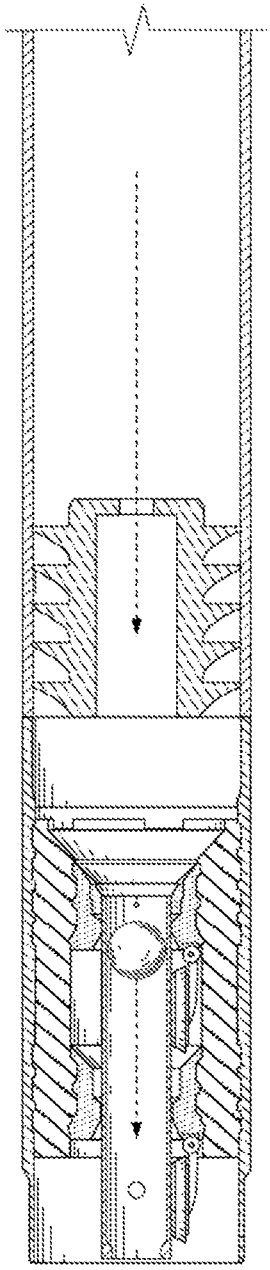
Figure 2D:
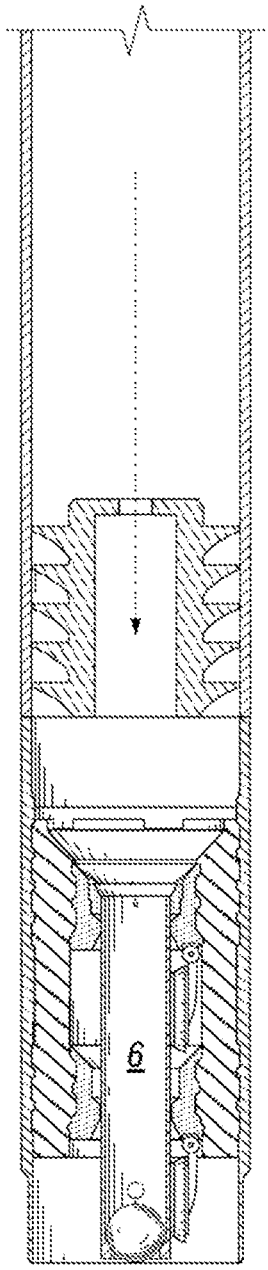
Figure 2E:
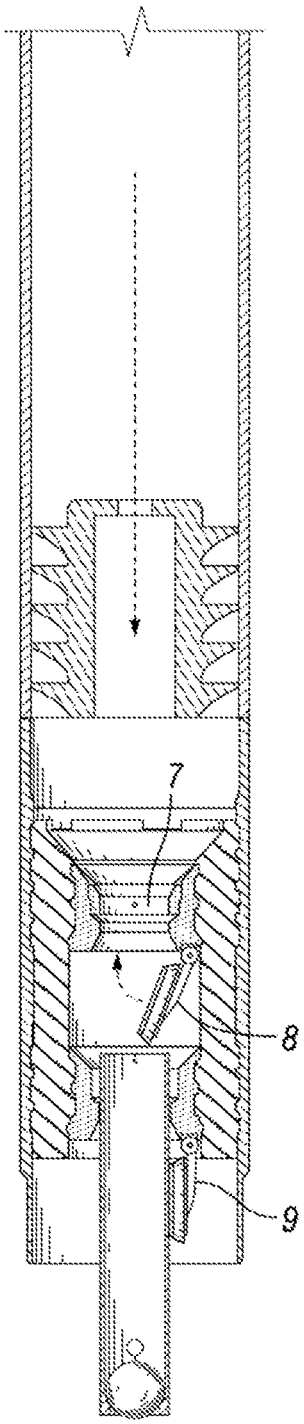
Figure 2F:
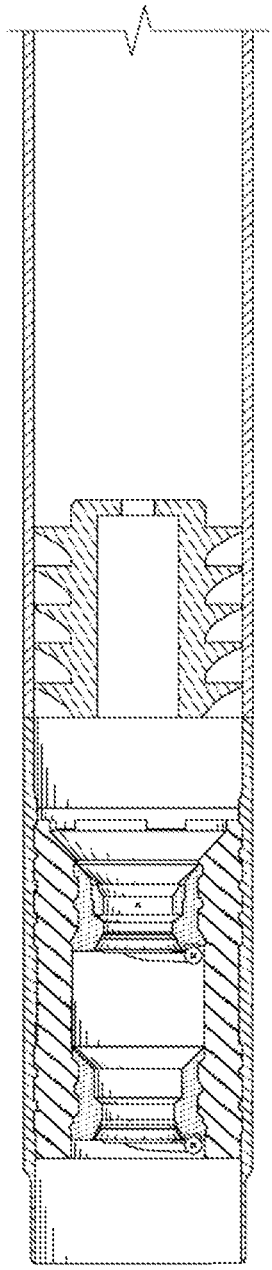

The method by which the new bottom cementing plug is applied to activate autofill float equipment is depicted in FIG. 2. The method shown by FIG. 2 employs a ball as the activation device and a breakable cup as the fixing means. The technique is shown in six steps, shown as A through F. Step A shows an autofill float collar 1 mounted at the bottom of a tubular string 2. As the tubular string is lowered into the subterranean wellbore, the flow direction of wellbore-service fluid (e.g., drilling fluid) through the autofill float collar and tubular string is upward 3. In Step B, the wellbore-fluid circulation direction is reversed 4 so that fluid travels down the tubular string, through the float collar and up the annulus between the tubular string and the wellbore wall. The new bottom cementing plug 10 has been launched inside the tubular string, and is traveling down toward the autofill float collar. The interior of the plug contains a flow passage 11 and a ball 12 seated in a breakable cup 13. A breakable membrane 14 at the top of the plug separates the flow passage from the wellbore-service fluid inside the tubular string. Step C shows that the plug has landed on the autofill float collar. Continued pumping of wellbore-service fluid increases the pressure on the plug, rupturing the membrane and allowing wellbore-service fluid to flow into the interior flow passage. Flow of wellbore-service fluid through the plug ruptures the cup supporting the ball, the ball exits the bottom of the plug and enters the autofill float collar. In Step D, continued pumping causes the ball to become seated in an orifice tube 6. In Step E, continued pumping of wellbore service fluid increases the pressure above the ball, causing shear pins 7 to rupture and release the orifice tube. Ejection of the orifice tube exposes one-way flapper valves 8 and 9, allowing activation of the float collar. The flapper valves close, thereafter allowing fluid flow toward the annulus but preventing fluid flow in the opposite direction. Step F depicts the autofill float collar after activation is complete.

The method described may further comprise the use of activation devices that contain a chemical substance. The chemical substance is released into the well after exiting the bottom cementing plug.

In yet a further aspect, embodiments aim at methods for cementing a subterranean well. Drilling fluid is circulated through the tubular body equipped with a float collar, passes through the float collar, exits the tubular string and continues to travel through the annulus between the tubular string and the wellbore wall. The bottom cementing plug is launched into the tubular body and begins traveling down the tubular string toward the float collar. The cementing plug is then followed by a cement slurry. The cement slurry may be preceded behind the cementing plug by a spacer fluid, chemical wash or both. As the plug travels through the tubular body, the breakable membrane at the top of the plug isolates the interior-flow passage and protects the activation device located therein from exposure to fluid flow. When the cementing plug lands on the float collar, continued pumping increases the differential pressure across the membrane, and the membrane ruptures. The fluid comprising a cement slurry enters the interior-flow passage, and flow ruptures the fixing means supporting the activation device. The activation device then exits from the bottom of the cementing plug, enters the autofill float collar and becomes lodged in the orifice tube. Continued pumping increases pressure inside the float collar, causing shear pins to break and release the orifice tube. As the orifice tube is expelled from the float collar, flapper valves are exposed. The flapper valves close, thereafter restricting fluid flow to the direction leading to the annulus between the tubular string and the wellbore wall. The fluid comprising a cement slurry exits the float collar and the tubular string, and continues into the annulus between the tubular string and the wellbore wall. Once pumping stops, the activated float collar prevents the cement slurry from flowing back into the tubular string.

The method described may further comprise the use of activation devices that contain a chemical substance. The chemical substance is released into the well after exiting the bottom cementing plug.

The apparatus and methods described above are particularly useful in deviated wells, generally at deviations above about 30° up to and including horizontal wells. The operator knows the location of the activation device at all times, thus improving activation of the autofill float collar at the correct moment.

The apparatus and methods described above may also allow operators to measure the exact internal volume of the tubular string. Knowing the pump efficiency and recording the wellbore-service volume pumped between the time at which the bottom plug is launched, and the time at which the bottom plug lands on the autofill float equipment, it is possible to calculate the exact internal volume of the tubular string. Landing of the bottom plug on the autofill float equipment will be indicated by a pressure surge arising from rupture of the membrane on the bottom plug and breakage of shear pins in the float equipment. Knowledge of the exact internal volume gives the operator the ability to more accurately displace subsequent plugs, ensuring their timely arrival at the correct location.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

I claim:

1. A method of activating autofill float equipment, comprising:

i. launching a plug having a top and a bottom, comprising an interior flow passage with an activation device contained therein, the top of the plug having a breakable membrane covering the flow passage, and the bottom of the plug having an opening through which the activation device may pass inside a tubular string that is installed in a subterranean wellbore having an angle of deviation, the tubular string being equipped with an autofill float collar;

ii. pumping a wellbore-service fluid behind the plug at a pumping pressure, causing the plug to travel down through interior of the tubing string;

iii. allowing the plug to land on the autofill float collar;

iv. increasing the pumping pressure until the breakable membrane ruptures, allowing wellbore-service fluid to enter the flow passage containing the activation device; and v. continuing to pump, allowing the activation device to exit the plug, enter the autofill collar and become lodged in an orifice tube, thereby causing expulsion of the orifice tube from the float collar, and activation of the float collar.

2. The method of claim 1, wherein the activation device is selected from the group consisting of balls, darts, canisters and bombs.

3. The method of claim 1, further comprising a breakable fixing means inside the flow passage that supports the activation device.

4. The method of claim 1, wherein the activation device contains a chemical substance that may be released after the activation device exits the plug.

5. The method of claim 1, wherein the angle of deviation of the wellbore is greater than about 30°.

6. A method of activating autofill float equipment, comprising:

i. launching a plug having a top and a bottom, comprising an interior flow passage with an activation device contained therein, the device containing a chemical substance, the top of the plug having a breakable membrane covering the flow passage, and the bottom of the plug having an opening through which the activation device may pass inside a tubular string that is installed in a subterranean wellbore having an angle of deviation, the tubular string being equipped with an autofill float collar;

ii. pumping a volume of a wellbore-service fluid behind the plug at a pumping pressure, causing the plug to travel down through interior of the tubing string;

iii. allowing the plug to land on the autofill float collar;

iv. increasing the pumping pressure until the breakable membrane ruptures, allowing wellbore-service fluid to enter the flow passage containing the activation device;

v. continuing to pump, allowing the activation device to exit the plug, enter the autofill collar and become lodged in an orifice tube, thereby causing expulsion of the orifice tube from the float collar, and activation of the float collar; and vi. releasing the chemical substance into the process fluid.

7. The method of claim 6, wherein the activation device is selected from the group consisting of balls, darts, canisters and bombs.

8. The method of claim 6, further comprising a breakable fixing means inside the flow passage that supports the activation device.

9. The method of claim 6, wherein the angle of deviation of the wellbore is greater than about 30°.

10. The method of claim 6, further comprising recording the volume of wellbore-service fluid pumped between the time the plug is launched, and the time at which the plug lands on the autofill collar, thereby providing an accurate measurement of the internal volume of the tubular string.

11. A method of cementing a subterranean well, comprising:

i. circulating drilling fluid through a tubular string installed in a subterranean wellbore having an angle of deviation, the tubular string being equipped with an autofill float collar;

ii. launching a plug having a top and a bottom, comprising an interior flow passage with an activation device contained therein, the top of the plug having a breakable membrane covering the flow passage, and the bottom of the plug having an opening through which the activation device may pass inside the tubular string and behind the drilling fluid;

iii. pumping a fluid system at a pumping pressure comprising a cement slurry into the tubular string behind the plug;

iv. continuing to pump, causing the plug to travel through the interior of the tubular string;

v. allowing the plug to land on the autofill float collar;

vi. increasing the pumping pressure until the breakable membrane ruptures, allowing the fluid comprising a cement slurry to enter the flow passage containing the activation device;

vii. continuing to pump, allowing the activation device to exit the plug, enter the autofill collar and become lodged in an orifice tube, thereby causing expulsion of the orifice tube from the float collar, and activation of the float collar; and viii. continuing to pump the fluid comprising a cement slurry into the annulus between the tubular string and the wellbore wall.

12. The method of claim 11, wherein the activation device contains a chemical substance, and the substance is released when the device exits the plug.

13. The method of claim 12, further comprising continuing to pump the fluid comprising a cement slurry into the annulus between the tubular string and the wellbore wall after the chemical substance has been released.

14. The method of claim 11, wherein the angle of deviation of the wellbore is greater than about 30°.

15. The method of claim 11, wherein the cement slurry is preceded by a spacer fluid, a chemical wash, or both.

16. The method of claim 11, further comprising recording the volume of cement slurry pumped between the time the plug is launched, and the time at which the plug lands on the autofill float collar, thereby providing an accurate measurement of the internal volume of the tubular string.

17. The method of claim 11, wherein the activation device is selected from the group consisting of balls, darts, canisters and bombs.

18. The method of claim 11, further comprising a breakable fixing means inside the flow passage that supports the activation device.

19. The method of claim 17, wherein the activation device is a ball or a dart.

20. The method of claim 19, wherein the activation device is a ball.

* * * * *